United States Patent [19]

Young et al.

[11] Patent Number: 4,618,093

[45] Date of Patent: Oct. 21, 1986

[54] RAIL INSULATION PADS

[75] Inventors: Hartley F. Young, West Melton; John Collins, Ingle Farm, both of Australia

[73] Assignee: Ralph McKay Limited, Maidstone, Australia

[21] Appl. No.: 622,863

[22] Filed: Jun. 20, 1984

[30] Foreign Application Priority Data

Dec. 13, 1983 [AU] Australia ..... PG2833/83
Dec. 20, 1983 [AU] Australia ..... PG2923/83

[51] Int. Cl.[4] ..... E01B 9/30; E01B 21/04; E01B 29/24

[52] U.S. Cl. ..... 238/283; 238/304; 238/351

[58] Field of Search ..... 238/351, 283, 304

[56] References Cited

U.S. PATENT DOCUMENTS

| | | | |
|---|---|---|---|
| 2,656,116 | 10/1953 | Protzeller | 238/283 |
| 4,216,904 | 8/1980 | Vivion | 238/283 X |
| 4,379,521 | 4/1983 | Young et al. | 238/351 X |

FOREIGN PATENT DOCUMENTS

| | | | |
|---|---|---|---|
| 28158/71 | 4/1971 | Australia . | |
| 479377 | 12/1976 | Australia . | |
| 26076 | 12/1978 | Australia . | |
| 917292 | 1/1963 | United Kingdom | 238/283 |

*Primary Examiner*—Richard E. Gluck
*Attorney, Agent, or Firm*—Christel, Bean & Linihan

[57] ABSTRACT

A rail pad for electrically and dynamically insulating the rail from the rail tie. Grooves or recesses are provided for force attenuation such that the overall volume is reduced by at least 15%. To improve durability particularly in curved track sections at least the field edge of the pad has in a section extending 20 mm on from the field edge less than 10% volume reduction by grooves or recesses.

12 Claims, 29 Drawing Figures

13
15
17
19
21
22
A
B
14
16

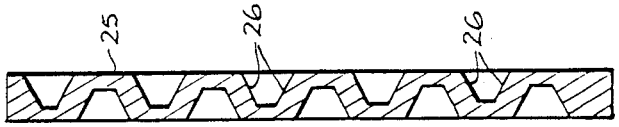
FIG. 6c.
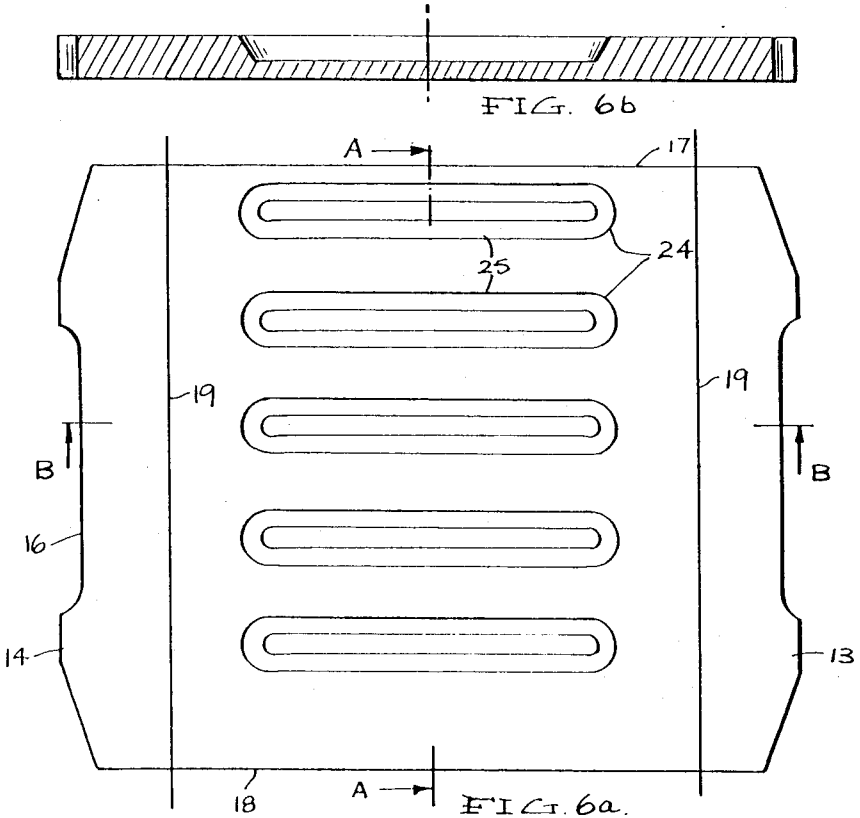
FIG. 6b
FIG. 6a.

A
B
13
14
15
16
17
18
19
27

RAIL INSULATION PADS

This invention relates to rail fastening systems and in particular rail insulating pads which are used to electrically and dynamically insulate the rail from the rail tie.

Australian Pat. No. 479377 discloses a commonly used form of rail insulating pad which is of thin cross-section and provides tapered side edges to reduce the incidence of damage or cracking to the rail pad.

Where concrete rail ties are used it has been found that cracking or splitting of the tie can be caused by impact forces arising from flattened portions in the train wheels circumferences or from the train wheel striking indentations or protrusions in the rail (e.g. a welding seam). It has been realized that one means of reducing the incidence of this type of damage was to utilize a rail pad with force attenuation properties as well as electrical insulating properties. An obvious solution was to provide a thicker rail pad of an elastic material such as rubber.

However, thickness alone is not the answer. Attempts have been made to provide improved attenuation. Australian patent specification (lapsed) No. 28158/71 discloses a pad having a series of ribs on its upper and lower surfaces which it is claimed reduce vibration and noise. Australian patent specification No. 508353 discloses a rail pad of high density polyethylene (a resilient but non flexible hard material) which incorporates a series of radial recesses intended to reduce cracking of the pad due to non-uniform rail and rail tie surfaces.

Although the provision of ribs or recesses in the rail pads may have some effect in reducing damage to rail ties and to the pads themselves the incidence of damage will still be high particularly in curved sections of track where the loads to which the pads and rail ties are subjected are concentrated on one side of the rail.

A problem which can occur with thick resilient rail pads is that in curved sections of track the load on the rail places the load onto one side of the pad, generally the field edge or outside edge. If the pad is relatively soft the rail is more easily tilted and it is possible under heavy loads for the rail to be toppled from the rail seat.

It is an object of this invention to improve the attenuation properties of rail insulation pads and also to reduce the likelihood of damage to such pads.

To this end the present invention relates to a rail fastening system of the kind in which a rail is fastened to a rail tie by a rail seat consisting of a rail tie a rail pad between the tie and the rail; a pair of rail clamp supports secured to said tie on either side of said rail and abutting said rail pad; rail clamp associated with each rail clamp support each clamp having a portion secured in said clamp support and a portion bearing down on said rail flange, and a clamp insulator lying on said rail flange to electrically insulate said rail flange from said rail clamp and said clamp support. The improvement according to the invention comprises the provision of a rail pad to electrically and dynamically insulate said rail tie from said rail which pad is composed of material having a high spring rate and the field edge portions of the pad extending 20 mm inwardly from the field edge of the rail are reduced in volume by less than 10% by the provision of grooves and recesses in either pad surface and the portion of the pad lying below the rail is reduced in volume by at least 15% by the provision of grooves and recesses in either pad surface. This invention also relates to the construction of the pad itself.

The field edge portions of the pad which require the hardness to resist deformation and bear the load of the rail have a width sufficient to support the load but insufficient to completely inhibit lateral stretching of the material under load. Preferably this applies to both the field edge (the outside of the rail) and the gauge edge (inside of rail) side of the pad so that the pad does not have to be laid in a particular way. In order for attenuation of the load to occur the pad material must be able to deform in the lateral direction. However, where surface contact is high frictional resistance prevents such lateral movement. Preferably the overall volume reduction of the pad underneath the rail, by the recesses or grooves is greater than 20% more preferably greater than 30% and the volume reduction in the 20 mm strip inwardly of at least the field edge of the rail is preferably less than 7½% more preferably less than 3%. Preferably both sides of the pad parallel to the rail are arranged in this way.

BRIEF DESCRIPTION OF BACKGROUND DRAWINGS

FIGS. 1*a*, 1*b* and 1*c* are diagrammatic views illustrating application of load to a conventional rail pad and FIGS. 2*a*, 2*b* and 2*c* are similar diagrammatic views of a recessed pad of harder material.

To further explain the problem overcome by this invention, reference is made to FIGS. 1A, B and C which illustrate a conventional thick rail pad which is used to provide high force attenuation. Where the pad is located on curved track and the load is applied along the line D as shown in 1A the pad initially will deflect vertically as shown in 1B which results in a reduction in the bearing width E—E being reduced. This reduction in bearing width means that greater deflection of the pad results which in turn results in a further reduction of bearing width on the field edge side as shown in F—F in FIG. 1C. This leads to instability of the rail seat and excessive wear on the rail pad.

In FIGS. 2A to 2C, a similar situation is shown except a harder material is used for the pad but a recess in the pad under the rail provides higher attenuation. The bearing width G—G on the field side of the pad under a diagonal load D remains virtually constant.

In order to optimize the resistance to damage by the rail and the attenuation of the load this invention provides that the material of the pad is resilient, flexible and has an optimum combination of hardness, ductility or resilience, resistance to cutting and a high spring rate. Preferably there should be used a natural or synthetic rubber blended to give a hardness of 68 to 90 DURO-A with abrasion and cutting resistance and resistance to permanent compression under high load durations (creep resistance).

A rail pad of such material would of itself have insufficient force attenuation. However, in accordance with this invention a pad of material having hardness within the range of 68 to 85 DURO-A and abrasion and cutting resistance is used wherein the portions of the pad underlying the rail are provided with grooves or recesses to provide higher force attenuation than the edge portions of the pad.

In the edge portions of the pad it is preferred that no grooves or recesses be provided which would reduce the bearing capacity of the pad. This means that the edge portions will have a high spring rate (the same as the selected material). However, the central portion of the pad must have high attenuation and it is essential to this invention that the central portion of the pad have a low load bearing capacity and a correspondingly low spring rate.

This may be achieved by providing a completely hollow central region with no material. If material is provided there is no need for it to contact either the rail or the rail tie and can take the form of a connecting web.

If surface contact between the pad and the rail or rail tie is required the area of contact should be low and the structure of the pad be such that the spring rate is low and high attenuation will occur. This can be provided by having the central region corrugated with grooves having sloping sides to reduce the bearing capacity of this portion of the pad, because the sloping walls of the corrugations when under load will be in shear, not compression. It is possible using this construction to use corrugations parallel to the longitudinal dimension of the rail extending completely across the pad. It is also possible to provide a lower spring rate in the centre of the pad by providing wide grooves of a depth greater than 50% of the pad thickness.

When thicker high force attenuating rail pads are used, considerable vertical deflection of the pad will occur. This deflection will of course vary with the hard ness of the pad material but is also related to pad thickness. The thicker the pad the greater the vertical deflection. This vertical deflection under load causes the pad to deform in a lateral direction from under the rail seat with each load pulse arising from the passage of a train wheel. However, the portion of the pad located between the rail and the rail clamp support shoulder is completely enclosed by the clamp support and the rail and this restricts such a lateral deformation. Instead the pad tends to deform upwardly under the clamp insulator which lies partly on the rail flange and partly on the rail pad between the flange and the clamp support. This upward force and movement on the clamp insulator leads in some cases to an early fatigue failure of the clamp insulator.

To overcome this particular difficulty this invention provides that a recess be incorporated in the rail pad in the portion of the pad which abuts the clamp support. This recess can be a hollow in the upper or lower surface of the pad or grooves into the upper or lower surface which have the effect of reducing the volume of the pad in that portion of the pad.

Such a recess will provide sufficient room for the pad to deform into, under load, without applying force to the clamp insulator. Preferably a recess is provided in the upper surface which lies beneath and within the boundary of the clamp insulator. It is preferred that the recess represents at least 10% preferably 25% of the volume of the pad lying between the edge of the clamp support which is parallel to the rail and the rail edge. The volume of the recess may be greater than 50% of the volume of this portion of the pad but no further advantage is obtained.

BRIEF DESCRIPTION OF THE DRAWING

This invention will now be described with reference to the drawings in which.

DETAILED DESCRIPTION

Figure 1A:
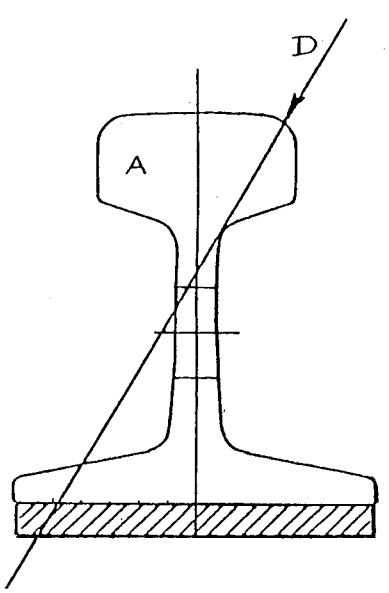
FIG. 1A (PRIOR ART)
Figure 1B:
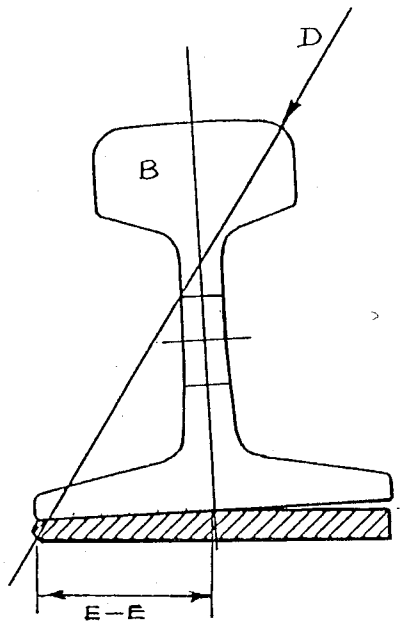
FIG. 1B (PRIOR ART)
Figure 1C:
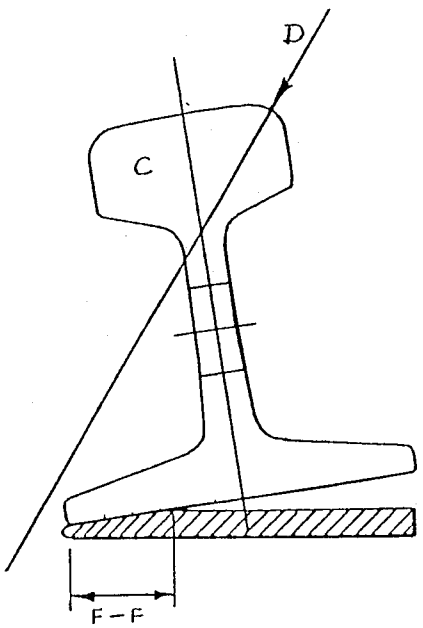
FIG. 1C (PRIOR ART)
Figures 2A, 2B, 2C:
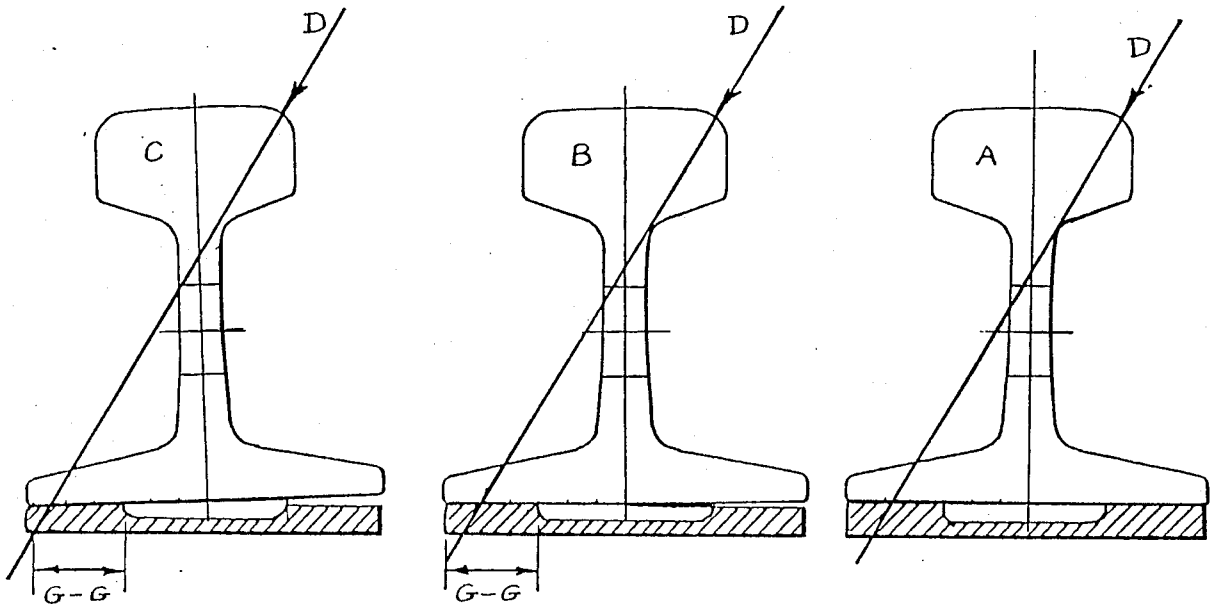
Figure 3:
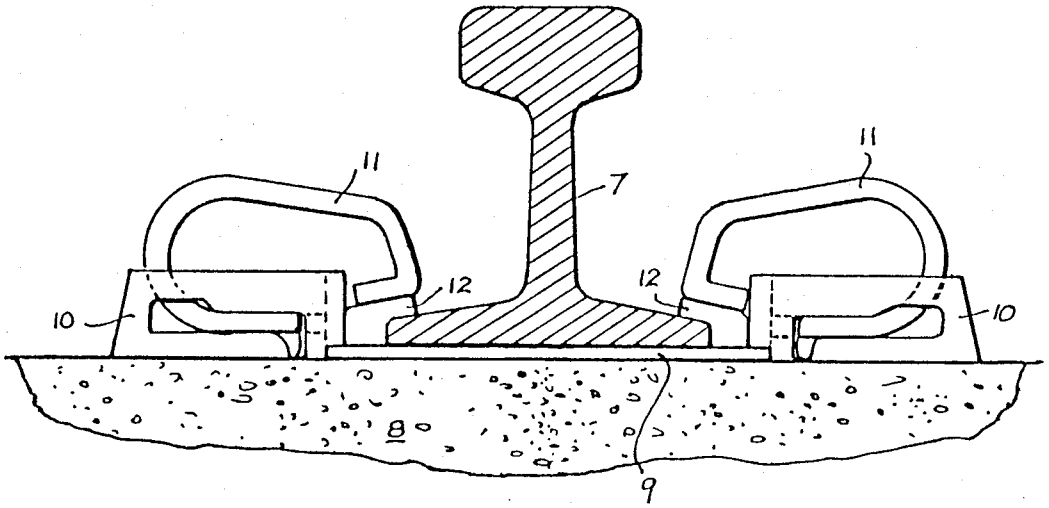
FIG. 3 (PRIOR ART)
FIG. 3 is a schematic view of a rail seat showing the position of the rail pad, FIGS. 4*a, b* and *c* are a plan, and two edge elevations of a preferred rail pad of this invention, FIGS. 5*a, b, c* are similar views of a modified version of the pad of FIGS. 4*a, b, c,* FIGS. 6*a, b, c* are similar views of another embodiment of this invention, FIGS. 7*a, b, c* are views of a further embodiment and figures 8*a, b, c* are views of a modification of the embodiment of FIGS. 7*a, b, c.

The rail seat as shown in FIG. 3 comprises the rail 7, the rail tie 8 and between them the rail insulation pad 9. On either side of the rail 7 and embedded in rail tie 8 are two rail clip support shoulders 10 and fitted to each is a clip 11 which bears down on the flange of rail 7. A clip insulator 12 insulates each clip 11 from the flanges of rail 7.

In each of FIGS. 4 to 8 the edge portions 13 and 14 of the rail pad lie adjacent and under the longitudinal edges of the rail flange and the edge recesses 15 and 16 are complementary in shape to the portions of the rail clip support shoulders which abut that portion of the rail pad. In all of the embodiments of this invention the edge portions 13 and 14 incorporate no recesses or grooves for a distance of 20 mm inwardly from the edge of the rail lying on the pad. The edges of the rail are shown as line 19 in the drawings.

In each of the embodiments the edge portions 17 and 18 are disposed at right angles to the rail's longitudinal dimension.

The material of the pads in each embodiment is preferred to be a blend of synthetic or natural rubber of hardness 68 to 90 DURO on the shore-A scale with good creep and cutting resistance.

Figures 4A, 4B, 4C:
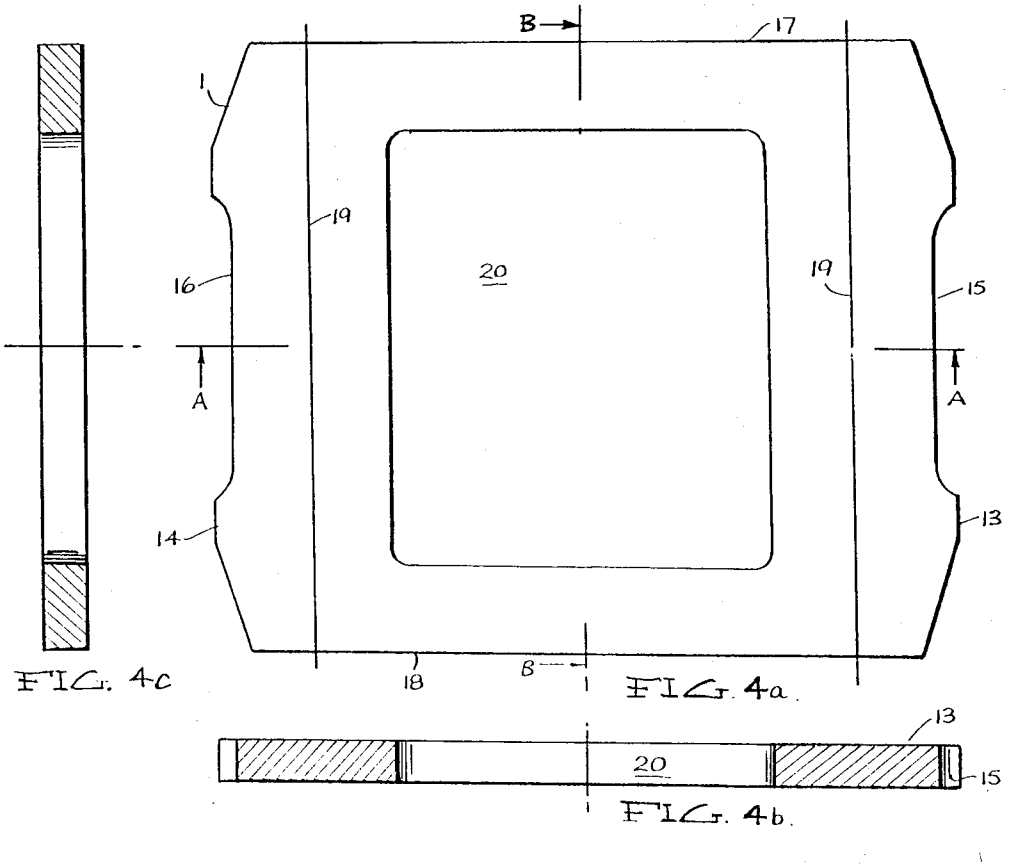

The embodiment of FIGS. 4*a, b, c* provides in the central portion 20 a complete absence of pad material except for the 20 mm strip inwardly from line 19.

Figures 5A, 5B, 5C:
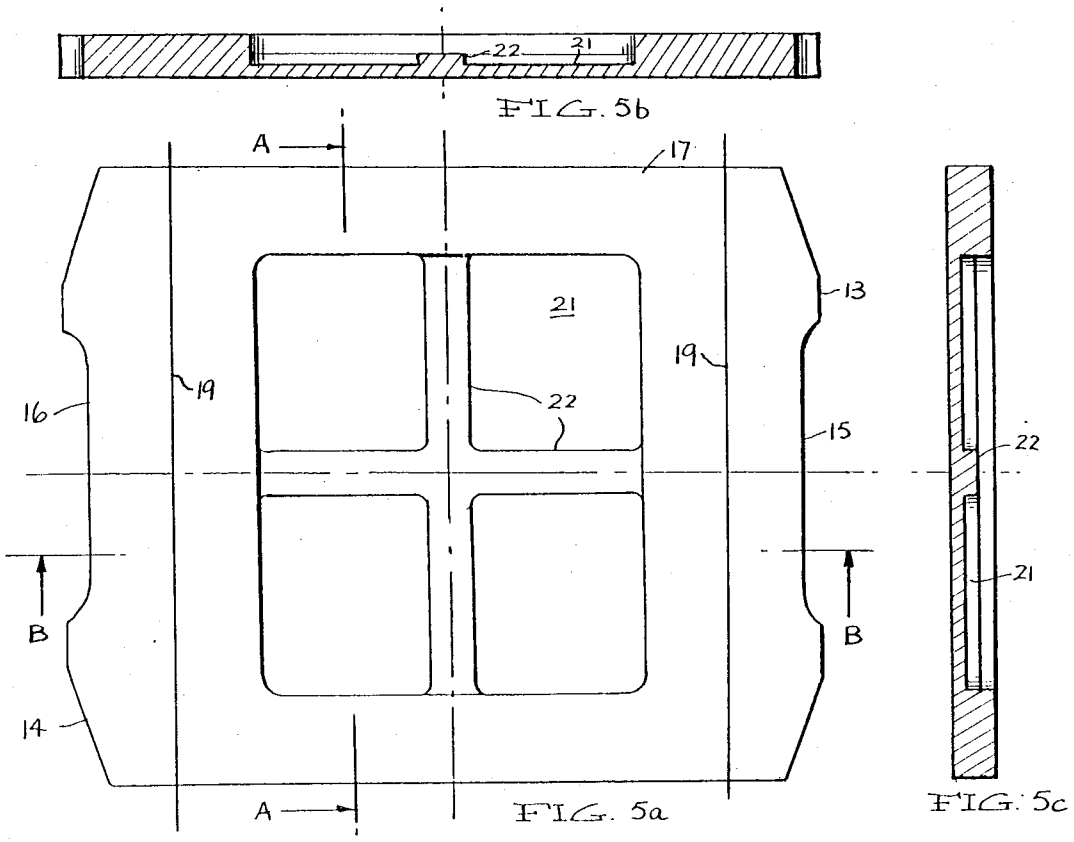

In FIGS. 5*a, b, c* a web 21 with raised ribs 22 which form a cross connects the four sides 13, 14, 17 and 18. It is to be noted that the web 21 and its ribs 22 do not provide any load bearing support.

In the embodiment of FIGS. 6*a, b, c* lateral corrugations 24 extend between sides 17 and 18. These corrugations have contact surfaces 25 and interconnecting walls 26 which are inclined to the vertical. This ensures that the load bearing capacity of these corrugations is low.

Figures 7A, 7B, 7C:
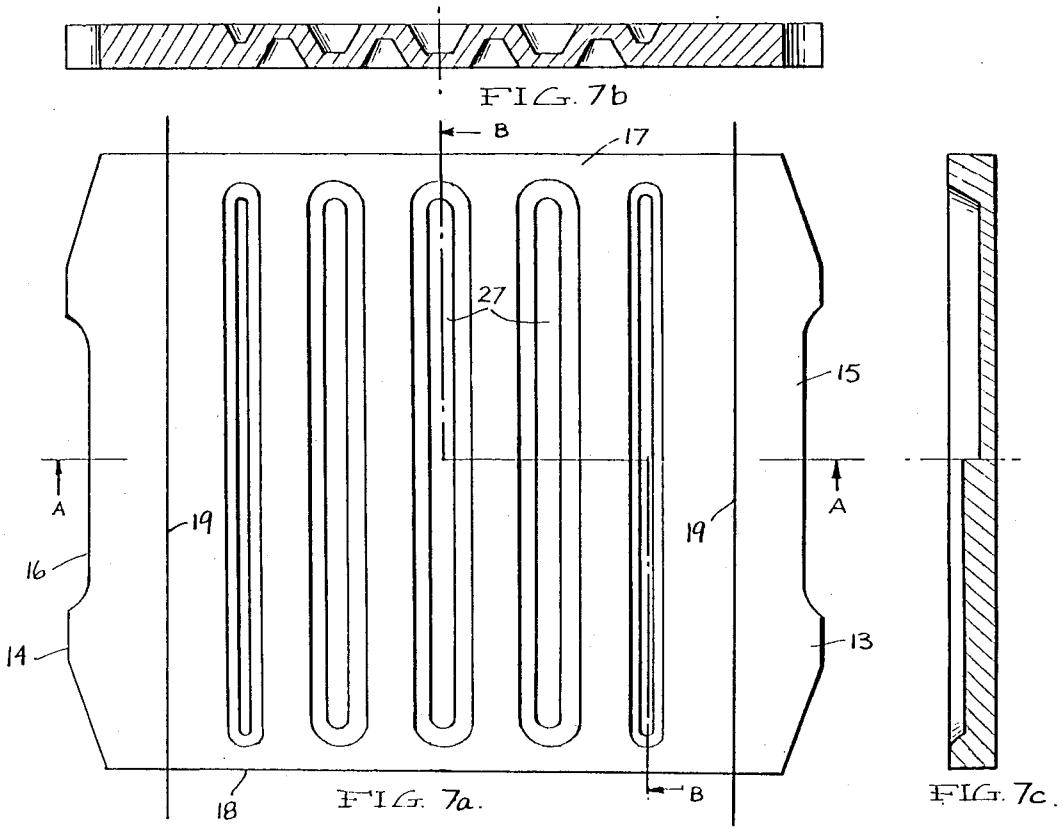

In FIGS. 7*a, b, c* an embodiment is illustrated in which the corrugations 27 are parallel to the longitudinal dimension of the rail and extend to near the edges 17 and 18 of the pad. As in the embodiment of FIGS. 6*a, b, c* the ends of the corrugations are curved to form a closed loop.

Figures 8A, 8B, 8C:
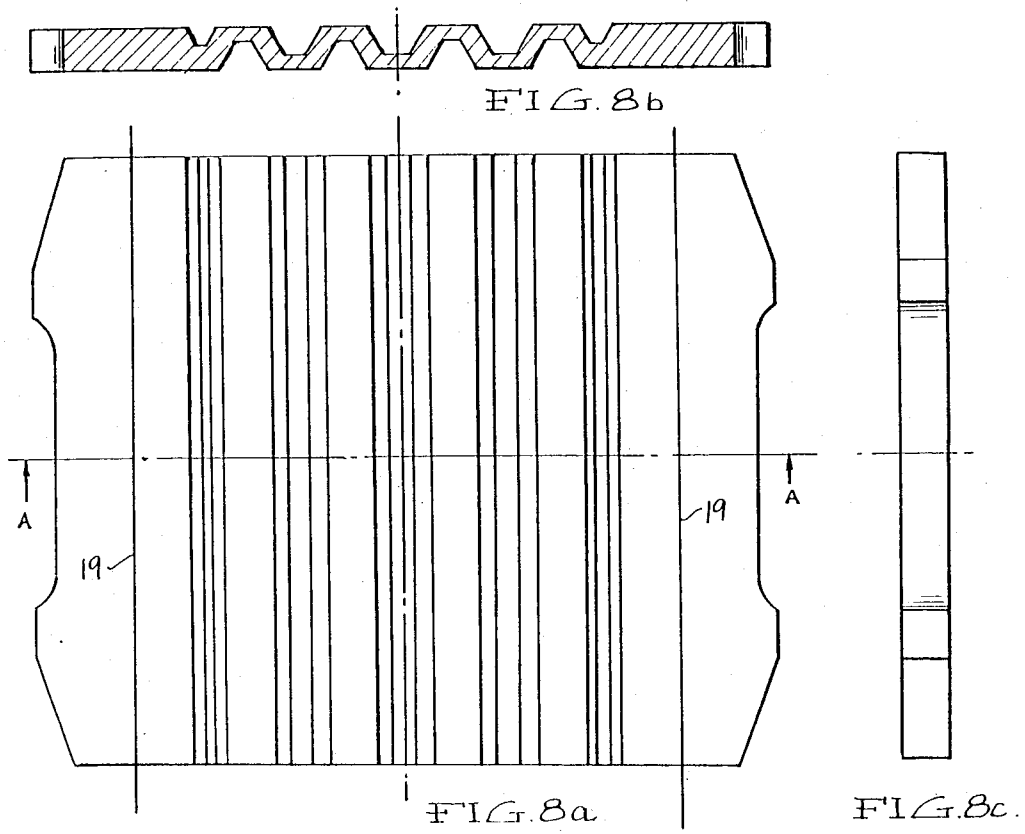

A variation of the embodiment of FIGS. 7*a, b c* is shown in FIGS. 8*a, b, c* in which the corrugations parallel to the longitudinal rail dimension extend out to edges 17 and 18 and do not form closed loops.

Figure 9B:
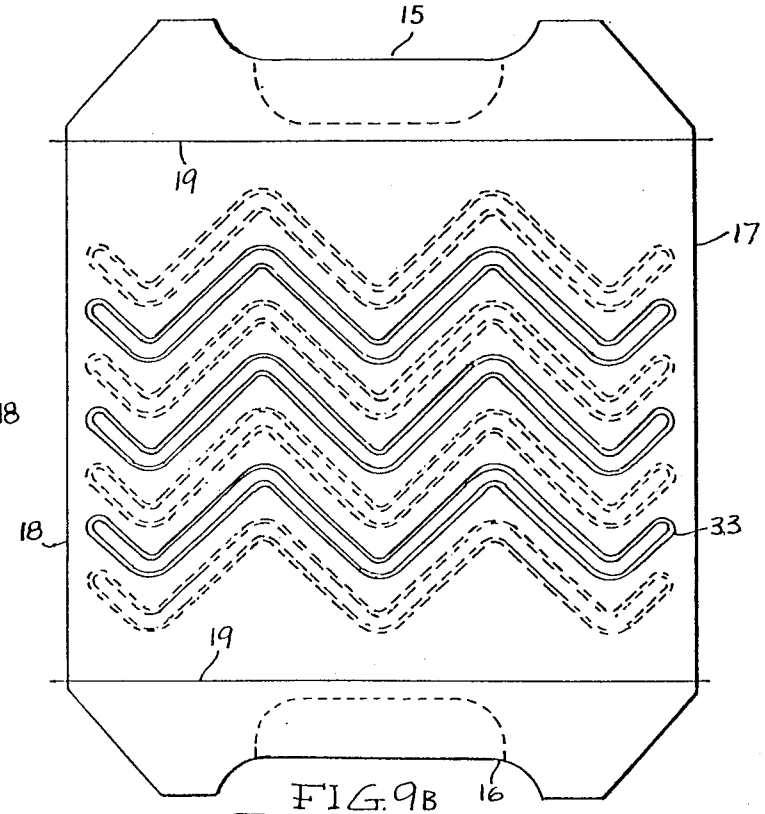
* FIGS. 9A to 9D illustrate a further embodiment of the pad.
Figure 9D:
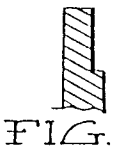
Figure 9A:
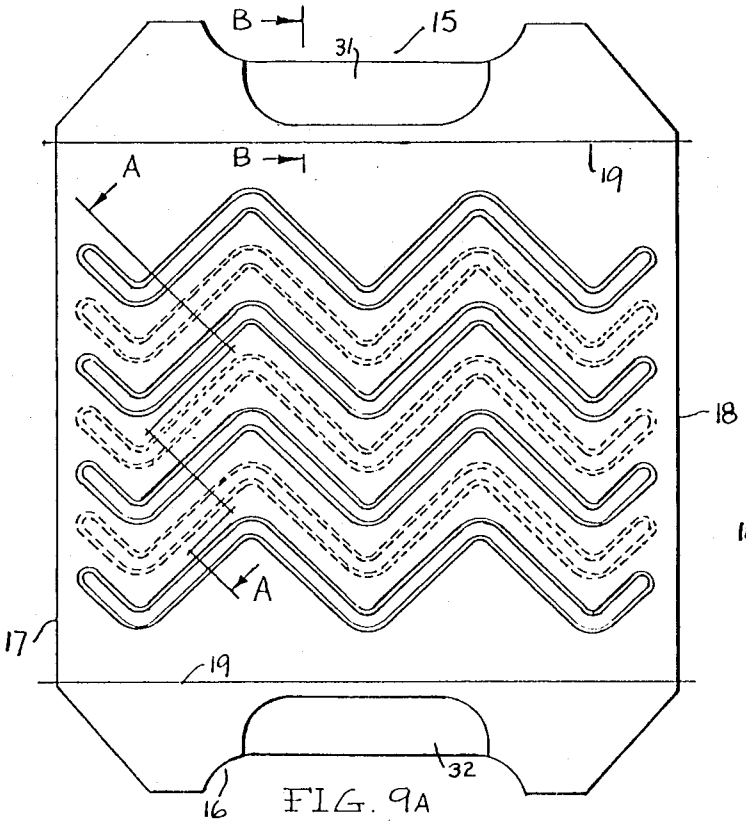
Figure 9C:
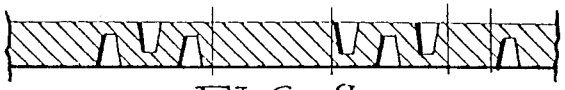

FIG. 9A shows a plan view of the upper surface of the pad and FIG. 9B is a plan view of the lower surface. FIG. 9C is a section view alone A—A of FIG. 9A and FIG. 9D is a section view along B—B of FIG. 9A. The recesses 31 and 32 in the upper surface of the pad adjacent edge recesses 15 and 16 respectively reduce the volume of the pad between the edge of the clamp support 10 parallel to the rail 7 and the edge of the rail 7 by 25%. The grooves 33 in each surface of the pad are 7 mm deep and are arranged in chevron formation with each alternate groove being on the top and bottom surface respectively.

Each of the above embodiments provide an increase in attenuation compared to prior art rail pads while at the same time providing an increased resistance to damage by the rail in curved sections of track. Some of the embodiments particularly those of FIGS. 4*a, b, c* and 5*a, b, c* use less material and consequently are cheaper to manufacture.

The claims defining the invention are as follows.

We claim:

1. In a rail fastening system of the kind in which a rail is fastened to a rail tie by a rail seat comprising a rail pad between the tie and the rail; said rail having a longitudinal axis and a rail flange terminating in a field edge; a pair of rail clamp supports secured to said tie on either side of said rail and abutting said rail pad; rail clamp associated with each rail clamp support each clamp having a portion secured in said clamp support and a portion bearing down on said rail flange, and a clamp insulator lying on said rail flange to electrically insulate said rail flange from said rail clamp and said clamp support, the improvement comprising said rail pad being provided to electrically and dynamically insulate said rail tie from said rail which pad is composed of material having a spring rate sufficiently high to provide required load bearing capacity, said pad having field edge portions extending 20 mm inwardly from the field edge of the rail toward the longitudinal axis of the rail which are reduced in volume by less than 10% by the provision of grooves and recesses which remove material in either pad surface and said pad having a control portion between said field edge portions which is reduced in volume by at least 15% by the provision of grooves and recesses which remove material in either pad surface, said pad being composed of a resilient, flexible material having a hardness within the range 68 to 90 DURO-Hardness on the shore-A scale.

2. The improvement of claim 1 wherein the central portion of the pad lying underneath the rail is reduced in volume by at least 20%.

3. The improvement of claim 1 wherein the volume of the pad lying 20 mm inwardly of the field edge of the rail is reduced by less than 7½%.

4. The improvement of claim 1 wherein the portion of the rail pad abutting the rail clamp support is recessed or grooved in the upper or lower surface of the pad to remove material and thereby reduce the volume of the pad in that portion.

5. The improvement as defined in claim 4 wherein the upper surface of the portion of the pad abutting the clamp support is recessed to remove material such that the volume of the pad lying between the edge of the clamp support parallel to the rail and the rail edge, is reduced by at least 10%.

6. A rail pad to electrically and dynamically insulate a rail tie from a rail having a longitudinal axis and a rail flange terminating in a field edge which pad is composed of material having a spring rate sufficiently high to provide required load bearing capacity and which has field edge portions extending 20 mm inwardly from the field edge of the rail toward the longitudinal axis of the rail which are reduced in volume by less than 10% by the provision of grooves and recesses which remove material in either pad surface and which has a central portion between said field edge portions which is reduced in volume by at least 15% by the provision of grooves and recesses which remove material in either pad surface, said pad being composed of a resilient, flexible material having a hardness within the range 68–90 DURO-Hardness on the shore-A scale.

7. The rail pad as claimed in claim 6 wherein the central portion of the pad lying underneath the rail is reduced in volume by at least 20%.

8. The rail pad as claimed in claim 6 wherein the volume of the pad lying 20 mm inwardly of the field edge of the rail is reduced by less than 7½%.

9. The rail pad of claim 6 wherein a portion of the rail pad is adapted to abut a rail clamp support which portion is recessed or grooved in the upper or lower surface of the pad to remove material and thereby reduce the volume of the pad in that portion.

10. The rail pad of claim 9 wherein the upper surface of the portion of the pad abutting the clamp support is recessed to remove material such that the volume of the pad lying between the edge of the clamp support parallel to the rail and the rail edge, is reduced by at least 10%.

11. The rail pad of claim 6 wherein the recesses or grooves have a depth of at least 50% of the pads thickness.

12. The rail pad of claim 6 wherein grooves are provided in both surfaces of the pad to a depth of more than 50% of the pad thickness, the grooves on each surface being alternately and laterally spaced from each other.

* * * * *